United States Patent [19]

Halliday

[11] Patent Number: 4,757,830

[45] Date of Patent: Jul. 19, 1988

[54] TOBACCO CONDITIONER

[75] Inventor: Norman V. Halliday, Andover, England

[73] Assignee: W. H. Dickinson Engineering Limited, Winchester, England

[21] Appl. No.: 901,375

[22] Filed: Aug. 28, 1986

[30] Foreign Application Priority Data

Sep. 19, 1985 [GB] United Kingdom ..... 8523168

[51] Int. Cl.[4] ..... A24B 3/12

[52] U.S. Cl. ..... 131/302; 131/303; 131/304

[58] Field of Search ..... 131/290, 300, 302, 305, 131/304

[56] References Cited

U.S. PATENT DOCUMENTS 4,513,759 4/1985 Wochnowski et al. ..... 131/305

FOREIGN PATENT DOCUMENTS 0395848 7/1933 United Kingdom ..... 131/305

*Primary Examiner*—V. Millin

*Attorney, Agent, or Firm*—Lee & Smith

[57] ABSTRACT

Tobacco conditioning apparatus comprising a covered generally U-shaped trough containing an axially extending rotatable paddle assembly. Tobacco to be conditioned is introduced through an aperture in the cover at the inlet end, and the trough is mounted with its axis inclined downwardly towards the outlet end so that the tobacco is progressively moved from the inlet to the outlet by rotation of the paddle assembly, while being conditioned with a steam spray. The tobacco leaves the outlet end through an aperture in the base of the trough.

8 Claims, 4 Drawing Sheets

TOBACCO CONDITIONER

This invention relates to tobacco conditioning, and particularly to conditioners intended for processing tobacco stems.

Conventional tobacco conditioners generally include a rotating cylinder which may be provided with internal projections or paddles to lift and tumble the product as it passes through the cylinder. Steam and/or water jets are incorporated to apply heat and/or moisture or chemical additives required in the specific process in use.

However, such systems require complex and heavy drive arrangements, including track rings and support rolls for the drum, and may also require a complex system of conduits and connectors, with special sealing to supply steam to the interior of the rotating drum.

Accordingly, the present invention seeks to provide a conditioner of simplified construction, with a less complex drive arrangement, improved access for internal cleaning, and improved sealing to reduce the amount of surplus vapour or liquids escaping from the device.

Accordingly, the present invention provides a tobacco conditioner comprising a stationary trough-like member which is inclined downwardly from an inlet end to an outlet end, and which has a base which is part circular in cross-section; and a paddle assembly which is axially mounted in the trough and includes one or more paddle members which extend in a generally radial direction so that their ends cooperate with the base of the trough.

In use, the paddles are rotated so that tobacco fed into the inlet end of the trough is alternately lifted and dropped by the paddle or paddles as they are rotated, causing it to move in the axial direction towards the delivery end.

Preferably, the paddle or paddles are mounted on an axially extending tubular member whose hollow interior acts as a conduit for steam or other conditioning agents, apertures being provided at intervals along the length of the tubular member, so as to direct the conditioning agent radially outwardly onto the tobacco.

This particular method of distributing the conditioning agent has the advantage that a particular mass of tobacco will be thoroughly conditioned as it is tumbled around the central axis by the paddles, since it will consequently have the conditioning agent applied to it from a large number of different angles.

Preferably the trough incorporates a cover which is removable to allow easy access to the interior for maintenance purposes.

One embodiment of the invention will now be described by way of example with reference to the accompanying drawings, in which.

Figure 4:
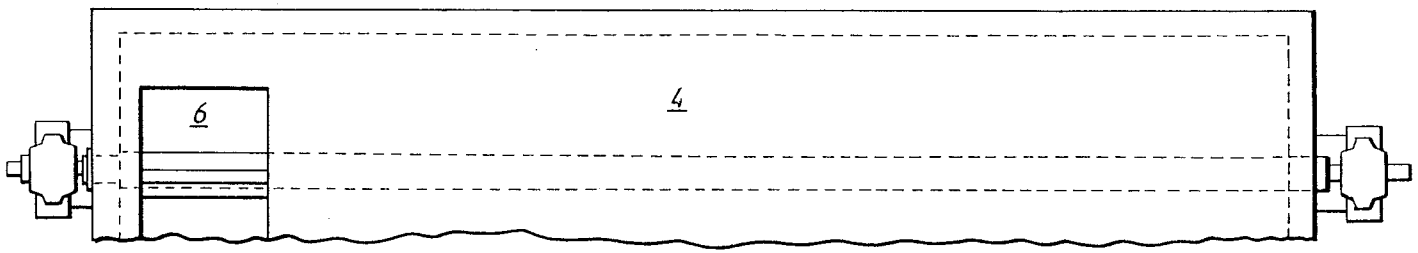
FIG. 4 is a partial top plan view of the device of FIG. 1.
Figure 1:
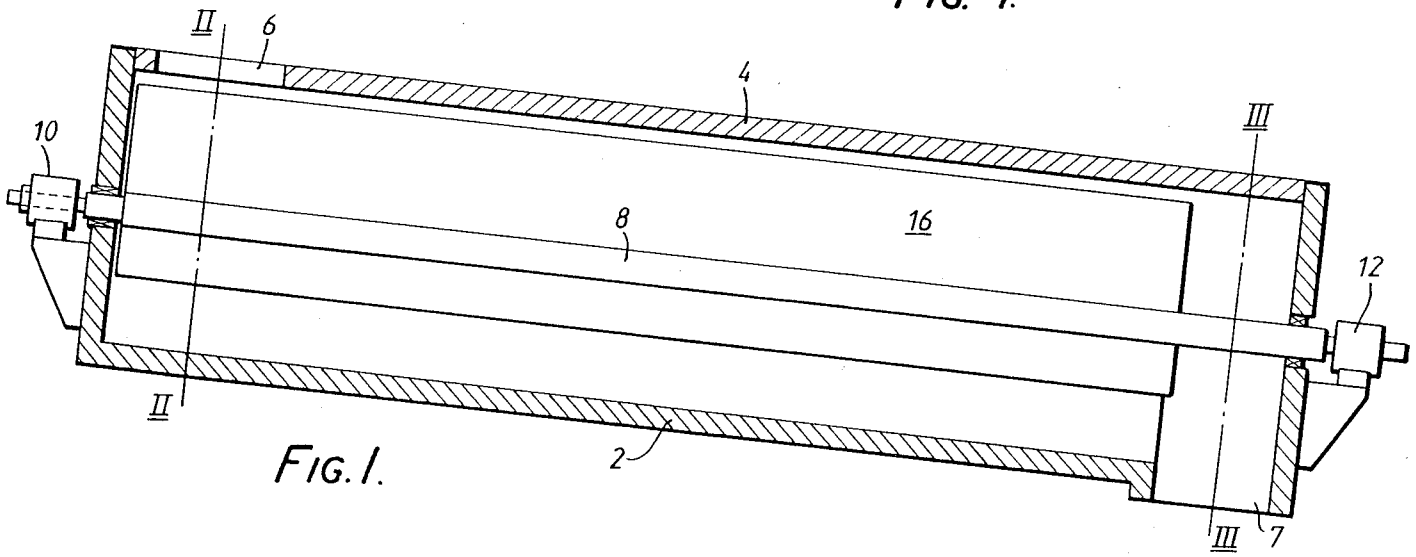
FIG. 1 is a longitudinal cross-section through a conditioner in accordance with the invention, taken in a vertical plane.
Figure 2:
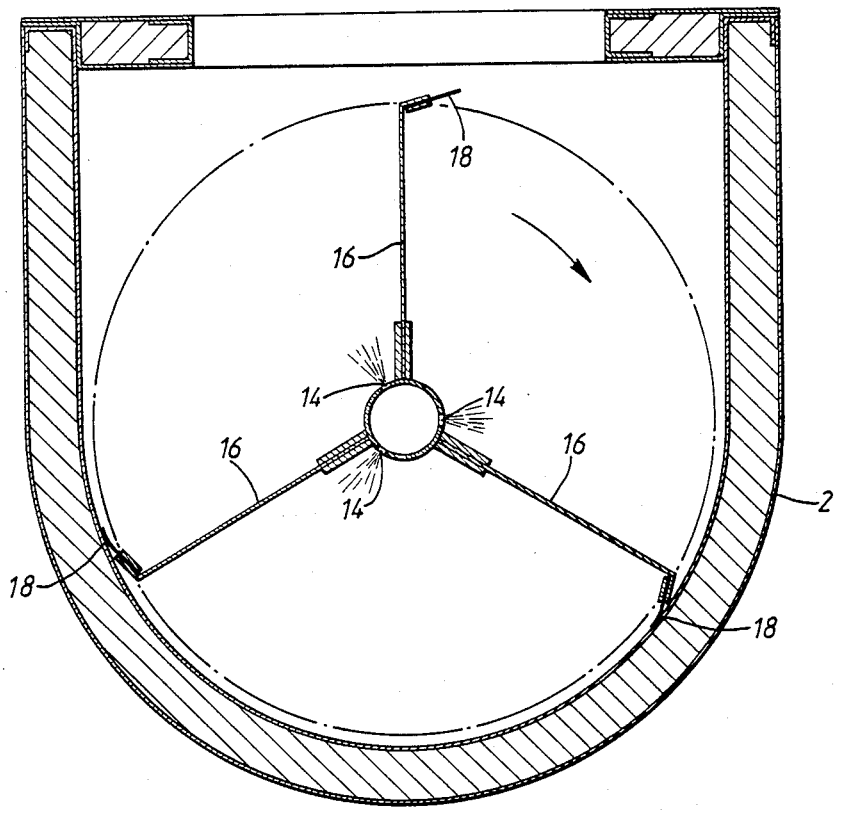
FIG. 2 is a transverse cross-section taken along the line II—II of FIG. 1, at the inlet end of the device.

Referring firstly to FIGS. 1 and 2, it will clearly be seen that the main body of the device comprises a trough 2 which is generally U-shaped in cross-section; and is inclined downwardly from the left-hand (inlet) end to the right-hand (outlet) end as seen in the drawing, preferably at an angle of 5°–10°. The trough is enclosed by a detachable cover 4 having an opening 6 at the inlet end into which tobacco is discharged from the end of the conveyor (not shown).

An axially extending rotatable tube 8 is rotatably mounted in tapered roller bearings held in housings 10 and 12 respectively, at the inlet and delivery ends of the device. A supply of steam (or other conditioning agent) is fed into the tube 8 whilst it is being rotated, and issues from a series of holes 14 spaced around the circumference of the tube, and along its length as shown in FIGS. 2 and 3.

Figure 3:
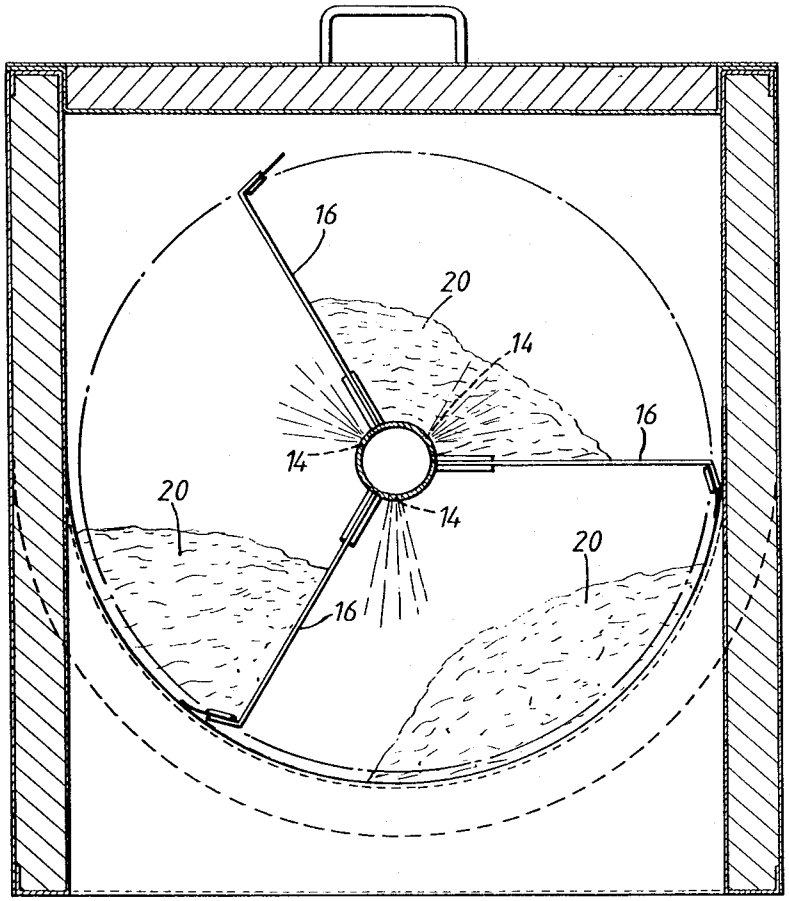
FIG. 3 is a transverse cross-section through the device taken along the line III—III of FIG. 1, at the delivery end of the device.

Three radially extending paddles 16 are mounted on the tubular member, and carry at their ends flexible wiper blades 18 which cooperate with the part circular cross-section of the interior of the base of the trough, so as to tumble the tobacco 20, FIG. 3, into a variety of different orientations as it passes along the trough. The movement of the tobacco along the trough is achieved purely by the effect of gravity combined with the tumbling movement, since the whole apparatus is inclined downwardly at a slight angle to the horizontal, from the inlet to the outlet end, at which there is an outlet aperture 7 in the base of the trough.

Figure 5:
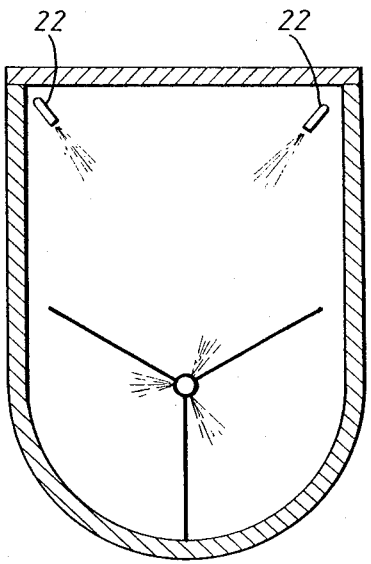
FIG. 5 is a further diagrammatic cross-sectional view similar to that of FIG. 3.

It will clearly be seen from FIG. 3, that the rotation of the tobacco around the central tube with its steam nozzles, causes it to be thoroughly conditioned and moistened during its passage along the length of the device. In addition, further sprays (22) may be mounted in the upper part of the trough above the paddles as shown in FIG. 5.

Figure 6:
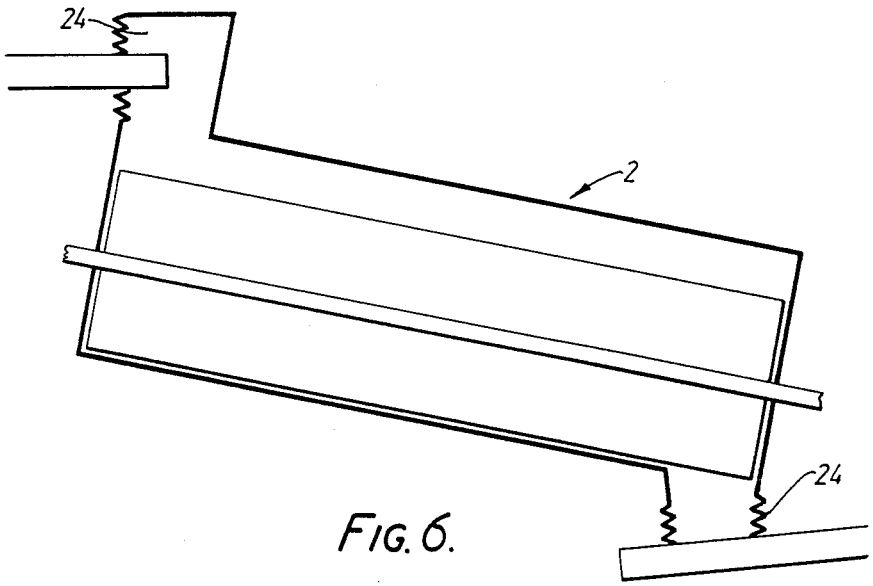
FIGS. 6 and 7 are further disgrammatic cross-sectional views of different embodiments corresponding to the view of FIG. 1.
Figure 7:
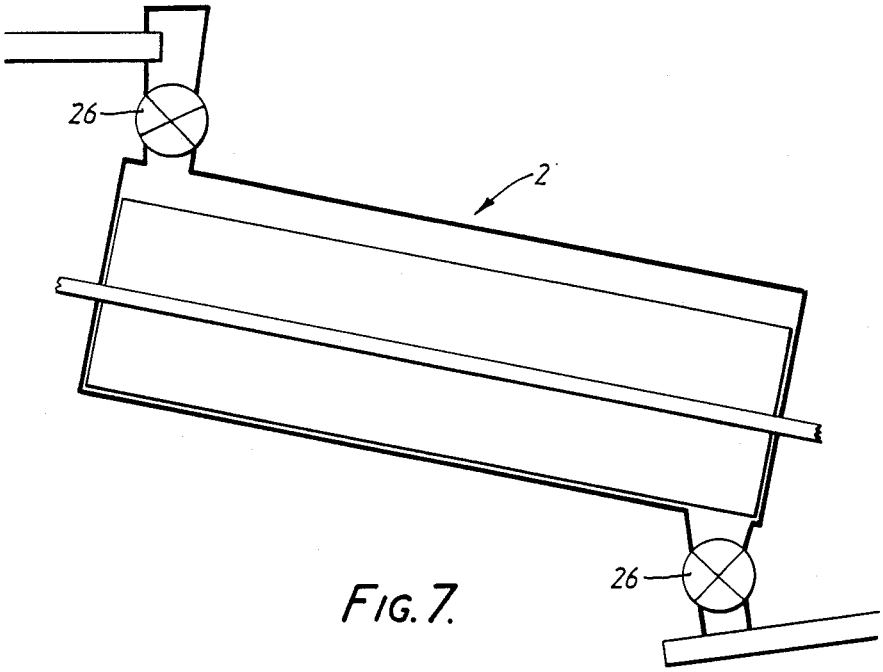

As shown in FIG. 6, the trough may also be provided with flexible seals 24 (for example of a "concertina" configuration) at the inlet and delivery ends to prevent the escape of vapour, and/or as shown in FIG. 7, rotary locks 26 may be provided to enable processing to take place at pressures different from atmospheric. These operate by providing rotatable compartments which alternately open to the inlet (or outlet) device or to the interior of the trough, so that the interior of the trough is never directly communicated with atmospheric pressure.

Since only the paddles are rotated, rather than the entire device (as in a conventional conditioner), the walls and cover of the trough can be substantially constructed, and as shown, each wall is formed from a double skin of metal enclosing thermal insulation material, so as to reduce energy losses as far as possible.

I claim:

1. Apparatus for conditioning tobacco comprising:

a stationary troughlike member having a base portion of part-cylindrical form, said troughlike member being fixed to prevent rotation thereof;

one end of said troughlike member including an inlet for receiving tobacco to be conditioned, and the other end including an outlet for conditioned tobacco;

said troughlike member being arranged with its longitudinal axis inclined downwardly from said inlet to said outlet;

a paddle assembly rotatably mounted co-axially with said part-cylindrical portion of said troughlike member, and including at least one radially extending paddle member whose outer end cooperates with the internal surface of said part-cylindrical portion;

and a plurality of spray nozzles arranged to direct conditioning agent onto said tobacco.

2. Apparatus according to claim 1 in which said paddle assembly includes a plurality of radially extending paddle members.

3. Apparatus according to claim 2 in which at least some of said spray nozzles are mounted in said troughlike member above said paddle assembly.

4. Apparatus according to claim 2 in which the paddle assembly includes an axially extending tubular member;

an inlet for conditioning agent at one end of said member;

and a series of spray apertures arranged along the length of said member for directing said conditioning agent onto said tobacco.

5. Appartus according to claim 2 in which the said troughlike member further comprises a removable cover member;

a first aperture being provided in said cover member at said inlet end to form an inlet for tobacco to be conditioned; and a second aperture being formed in the base of said troughlike member at said outlet end to form an outlet for conditioned tobacco.

6. Apparatus according to claim 5 further comprising flexible seal members for each of said inlet and outlet apertures.

7. Apparatus according to claim 5 further comprising a rotary air lock device for each of said inlet and outlet apertures.

8. Apparatus according to claim 2 further comprising a flexible blade-like member arranged at the end of each said paddle so as to cooperate with said troughlike member.

* * * * *